United States Patent [19]

Romanauskas

[11] 4,451,250

[45] May 29, 1984

[54] INSIDE ADAPTER FOR A SAMPLE CONTAINER

[75] Inventor: William A. Romanauskas, Southbury, Conn.

[73] Assignee: E. I. Du Pont de Nemours and Company, Wilmington, Del.

[21] Appl. No.: 424,474

[22] Filed: Sep. 27, 1982

[51] Int. Cl.[3] ..... B04B 7/00

[52] U.S. Cl. ..... 494/85; 494/16

[58] Field of Search ..... 494/16, 21, 45, 37, 494/17, 18, 19, 20, 85, 67, 76, 79; 220/71

[56] References Cited

U.S. PATENT DOCUMENTS

| | | | |
|---|---|---|---|
| 3,456,876 | 7/1969 | McEwen | 494/16 |
| 3,998,383 | 12/1976 | Romanauskas et al. | 233/26 |
| 4,015,775 | 4/1977 | Rohde | 233/26 |
| 4,166,573 | 9/1979 | Webster | 233/26 |
| 4,190,196 | 2/1980 | Larsen | 233/26 |
| 4,222,513 | 9/1980 | Webster et al. | 233/26 |

*Primary Examiner*—Robert W. Jenkins

[57] ABSTRACT

An adapter for supporting a centrifuge container from the inside surface thereof includes a bore extending through a portion thereof. The bore exhibits generally confronting planar surfaces each arranged to lie coincident with the radius of the rotor in which the container is disposed.

17 Claims, 2 Drawing Figures

INSIDE ADAPTER FOR A SAMPLE CONTAINER

BACKGROUND OF THE INVENTION

This invention relates to an adapter for a sample container for a centrifuge and, in particular, to an adapter for supporting a container from the inside surface.

It has been observed when using a vertical tube rotor such as the type disclosed in U.S. Pat. No. 3,998,383 (Romanauskas et al.) that unless a sample carrying container is completely filled with a sample (containing a liquid supernatant and particulate matter to be separated) the sample container is disfigured when exposed to a centrifugal force field. This is believed to be disadvantageous in that the disfigurement of the container has a tendency to open the sealed interface defined between the top of the container and a plug disposed therein.

Accordingly, it is believed advantageous to provide an adapter for use inside a container which adapter is able to receive a volume of sample to be centrifuged and is also able to support the container from the interior surface thereof so that the sealed integrity of the container is maintained intact.

SUMMARY OF THE INVENTION

In accordance with this invention an adapter is provided with an exterior surface corresponding to the inside surface of a sample-carrying container so as to be receivable therewithin. The adapter has a bore extending therethrough with the end of the adapter terminating a predetermined distance below the open end of the container. The adapter is arranged to support the container from the inside surface thereof during centrifugation so as to prevent the collapse and disfigurement of the container.

In a preferred embodiment of the invention the bore extending through the adapter, when viewed in a plane perpendicular to the axis thereof, includes a first and a second side generally coincident with the radius of the rotor.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figures 1, 2:
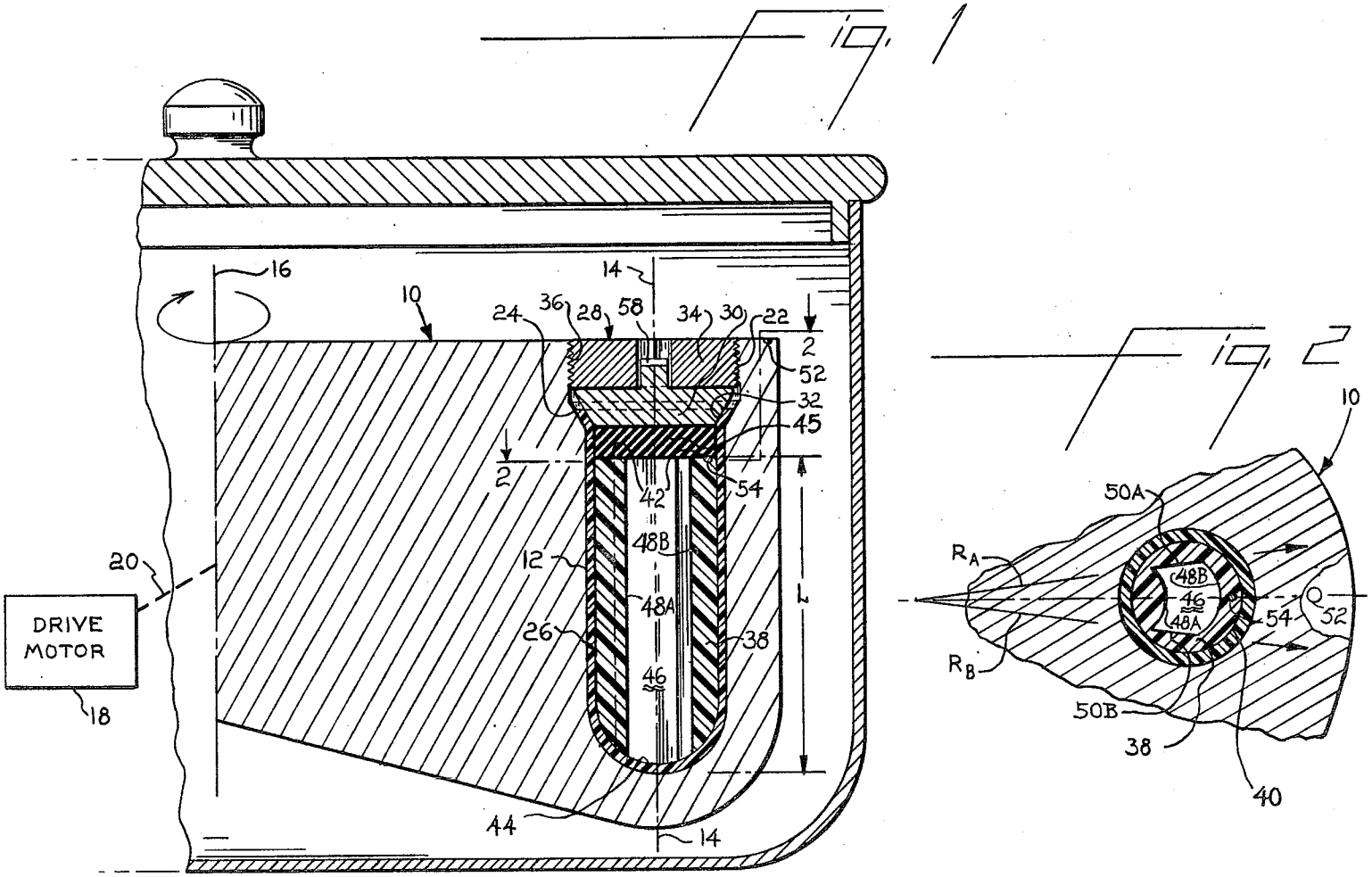
FIG. 1 is a side elevation view of a vertical tube rotor apparatus illustrating an inside adapter in accordance with the present invention.
FIG. 2 is a sectional view taken along section lines 2—2 of FIG. 1 illustrating the adapter in accordance with the preferred embodiment of the present invention.

Throughout the following detailed description similar reference numerals refer to similar elements in all figures of the drawings.

With reference to FIG. 1 shown in side elevation is a portion of a vertical tube rotor apparatus generally indicated by reference character 10 and generally in accordance with that disclosed in U.S. Pat. No. 3,998,383 (Romanauskas et al.). The rotor 10 includes a plurality of cavities 12 (only one of which is shown) disposed about the periphery thereof. The axis 14 of each cavity 12 extends generally parallel to the axis of rotation 16 of the rotor 10. Rotational energy is applied to the rotor 10 from a drive motor 18 linked in any suitable manner, as indicated by the schematic linkage 20, to the rotor 10. The upper end of each cavity 12 is provided with a threaded counterbore 22 which communicates with the lower portion of the cavity 12 through a flared portion 24.

Each cavity 12 is sized to receive a sample container 26 in a close sliding fit and support the same in a substantially vertical orientation. The open end of the container 26 is provided with a capping mechanism 28 to seal the container 26. The capping mechanism 28 includes a plug 30 having a peripheral flared portion 32 disposed thereon. A cap 34 having exterior threads 36 is arranged to be inerconnected with the threads provided on the counterbored portion 22 of the cavity 12. When the cap 34 is threaded into the counterbored portion 22 the plug 30 urges the container 26 outward to form a seal therebetween. Of course if desired other suitable cap and plug arrangements may be used, such as those described in U.S. Pat. Nos. 4,166,573 (Webster), 4,190,196 (Larsen) and 4,222,513 (Webster et al.), each assigned to the assignee of the present invention.

It has been found in practice that when the container 26 is provided with a sample (comprising a liquid and suspended particulate matter) that occupies a volume less than the full volume of the container 26 the container becomes disfigured when subjected to a centrifugal force field. As a result the sealed interface between the plug 30 and the container 26 may be ruptured. This occurrence is believed to be disadvantageous.

In accordance with this invention an adapter 38 is provided with an outer surface 40 sized to be received with a close sliding fit on the inside surface of the container 26. In practice the exterior surface 40 of the adapter 38 is preferably shaped so as to correspond to the shape of the container with which it is associated. However, any suitable configuration of the exterior surface 40 able to permit the receipt of the adapter 38 within the container 26 lies within the contemplation of this invention. In practice it is preferred that the lower end 44 of the adapter 38 conform to the shape of the inside bottom surface of the container 26. The adapter 38 is preferably fabricated of polyethylene although other suitable inert materials may be utilized. The adapter 38 has a length dimension L such that the upper end 42 of the adapter 38 lies just below the open end of the container 12. In this manner the presence of the adapter within the container will not impair or interfere with the formation of the sealed interface at the open end of the container 26. It may be desired to provide a gasket 45 above the adapter 38 to fill the space between it and the underside of the plug 30.

A bore 46 extends through a portion of the adapter 38 preferably, but not necessarily, symmetrically disposed with respect to the axis thereof. If desired (and as shown in FIG. 1), the bore 46 may extend totally through the adapter 38. The sample to be centrifuged is received within the volume defined by the bore 46 on the interior of the adapter. The bore 46 may exhibit any predetermined configuration as viewed in a plane perpendicular to the axis of the adapter. However, in the preferred embodiment of the invention shown in FIG. 2 the bore 46 is provided with confronting radially inner and outer surfaces 48A and 48B, respectively, interconnected by planar surfaces 50A and 50B. Preferably, the surfaces 48 are cylindrical but may be planar or any other desired shape. The planar surfaces 50 are selected such that they lie coincident with radii $R_A$ and $R_B$ emanating from the axis of rotation 16 of the rotor 10. This configuration shown in FIG. 2 is preferred because when an adapter 38 in accordance with this invention is introduced into a container 26 such that surfaces 50 of the bore thereof are coincident with the radii of the rotor 10 wall effects are avoided during centrifugation of the sample.

The rotor 10 and the container 26 may be provided with suitable indicia 52 and 54, respectively so that the adapter 38 may be inserted in the proper orientation with respect to the axis 16 of the rotor 10. Alternatively, the container 26 and the adapter 38 may be keyed in a suitable manner so as to facilitate insertion of the container 26 into the rotor so as to exhibit the proper orientation. In the Figures, for clarity of illustration only, the indicia are shown as beads projecting into the adapter 38 and the rotor 10 at radially corresponding positions therein. The plug 30 (FIG. 1) is provided with a slot 58 to maintain the preferred alignment of the tube 26 while the cap 34 is secured into position.

Those skilled in the art having the benefit of the teachings hereinabove set forth may effect numerous modifications thereto. These modifications are to be construed as lying within the scope of the present invention as defined in the appended claims.

What is claimed is:

1. An adapter for a container used for centrifugation of a sample, the container having a predetermined configuration on the interior surface thereof, the adapter having an external surface sized for receipt within the container, the lower end of the adapter being configured to conform to the configuration of the bottom of the container, the adapter further having a bore extending through a portion thereof, the bore having a first radially inner and a second radially outer surface connected by generally confronting first and second planar surfaces, the bore defining a volume adapted to receive a sample therein, the adapter being arranged to support the container from the interior surface thereof as the container is subjected to a centrifugal force field.

2. The adapter of claim 1 wherein the planar surfaces are arranged to lie coincident with a radius emanating from the axis of rotation of the rotor.

3. The adapter of claim 2 wherein the first and second surfaces are each cylindrical.

4. The adapter of claim 3 wherein the bore extends completely through the adapter.

5. The adapter of claim 2 wherein the bore extends completely through the adapter.

6. The adapter of claim 1 wherein the first and second surfaces are each cylindrical.

7. The adapter of claim 4 wherein the bore extends completely through the adapter.

8. The adapter of claim 1 wherein the bore 30 extends completely through the adapter.

9. An adapter for an open-ended container of the type used for centrifugation of a sample in a centrifuge rotor, the container having a cylindrical inner surface, the adapter comprising an exterior cylindrical surface sized for a close sliding fit on the interior of the container, the adapter having a bore extending through a portion thereof to define a volume to receive the sample to be centrifuged, the bore being defined by a first, radially inner, and a second, radially outer, surface connected by generally confronting planar surfaces, each planar surface being arranged to lie coincident with a radius emanating from the axis of rotation of the rotor.

10. The adapter of claim 9 wherein the radially inner and radially outer surfaces are cylindrical.

11. The adapter of claims 9 or 10 wherein the bore extends axially through the adapter.

12. The adapter of claim 11 wherein the adapter has an indicia thereon arranged to facilitate insertion of the adapter into the container such that the planar surfaces of the bore align with the radii of the rotor.

13. the adapter of claims 4 or 10 wherein the container has a rounded bottom and the adapter has a rounded lower end.

14. The adapter of claim 13 wherein the bore extends axially through the adapter.

15. The adapter of claim 14 wherein the adapter has an indicia thereon arranged to facilitate insertion of the adapter into the container such that the planar surfaces of the bore align with the radii of the rotor.

16. The adapter of claim 13 wherein the adapter has an indicia thereon arranged to facilitate insertion of the adapter into the container such that the planar surfaces of the bore align with the radii of the rotor.

17. The adapter of claims 9 or 10 wherein the adapter has an indicia thereon arranged to facilitate insertion of the adapter into the container such that the planar surfaces of the bore align with the radii of the rotor.

* * * * *